United States Patent [19]

Koppe

[11] Patent Number: 4,783,886

[45] Date of Patent: Nov. 15, 1988

[54] PAPER-LAMINATED PLIABLE CLOSURE FOR FLEXIBLE BAGS

[76] Inventor: Lou W. Koppe, P.O. Box 567, Athabasca, Alberta, Canada

[21] Appl. No.: 88,691

[22] Filed: Aug. 24, 1987

[51] Int. Cl.[4] ..... B65D 77/10

[52] U.S. Cl. ..... 24/30.5 S; 24/30.5 R; 24/487

[58] Field of Search ..... 24/30.5 S, 30.5 R, 304, 24/DIG. 11, DIG. 28, 487; 248/205.3

[56] References Cited

U.S. PATENT DOCUMENTS

| | | | |
|---|---|---|---|
| 2,005,569 | 6/1935 | Smith | 24/304 |
| 2,981,990 | 5/1961 | Balderree, Jr. | 24/30.5 S |
| 3,164,250 | 1/1965 | Paxton | 24/30.5 S |
| 3,818,553 | 6/1974 | Parmenter | 24/30.5 R |
| 3,822,441 | 7/1974 | Paxton | 24/30.5 S |
| 4,045,833 | 9/1977 | Mesek et al. | 248/205.3 |
| 4,428,134 | 1/1984 | Arnold et al. | 24/30.5 S |
| 4,486,923 | 12/1984 | Briggs | 24/30.5 R |

*Primary Examiner*—Victor N. Sakran
*Attorney, Agent, or Firm*—David Pressman

[57] ABSTRACT

A thin, flat closure for plastic bags and of the type having at one edge a V-shaped notch (12) which communicates at its base with a gripping aperture (14). The base (10) of the closure is made of a flexible material so that it can be repeatedly bent, without fracturing, along an axis aligned with said notch and aperture. In addition, upon one or both sides of the closure is laminated a layer of paper (20). The axis may contain one or two grooves (18) or a through-hole (26), either of which acts as a hinge to facilitate bending.

9 Claims, 4 Drawing Sheets

PAPER-LAMINATED PLIABLE CLOSURE FOR FLEXIBLE BAGS

BACKGROUND

1. Field of Invention

This invention relates to an improvement in the plastic tab closures used for closing the necks of plastic bags that are commonly employed in containing breads, produce, refuse, and the like.

2. Description of Prior Art

Grocery stores and supermarkets commonly supply polyethylene bags to consumers for the containment of items of produce. Such bags are also commonly used as packaging by suppliers in order to provide a resealable container for bread and other items, both edible and inedible.

Originally, these bags were sealed by the supplier with staples or by heat, but consumers objected to such methods of closure since they were of a rather permanent nature in that the bags could be opened only by tearing them, thereby damaging them and rendering them impossible to reseal.

Thereafter, inventors created several types of closures to seal plastic bags in such a way as to leave them undamaged after they were opened. U.S. Pat. No. 4,292,714 to Walker (1981) discloses a complex clamp which can close the necks of bags without causing damage upon opening; however, these clamps are prohibitively expensive to manufacture. U.S. Pat. No. 2,981,990 to Balderree (1961) shows a closure which is of expensive construction, being made of PTFE, and which is not effective unless the bag has a relatively long "neck"; thus, if the bag has been filled almost completely and consequently has a short neck, this closure is useless. Also, being relatively narrow and clumsy, Balderree's closure cannot be easily bent by hand along its longitudinal axis. And finally, his closure does not hold well onto the bag but has a tendency to snap off.

Although twist closures with a wire core are easy to use and inexpensive to manufacture, do not damage the bag upon being removed, and can be used repeatedly, nevertheless they simply do not possess the neat and uniform appearance of a tab closure, they become tattered and unsightly after repeated use, and they do not offer suitable surfaces for the reception of print or labeling. These ties also require much more manipulation to apply and remove.

Several types of thin, flat closures have been proposed—for example, in U.K. patent 883,771 to Britt et al. (1961) and U.S. Pat Nos. 3,164,250 (1965), 3,417,912 (1968), 3,822,441 (1974), 4,361,935 (1982), and 4,509,231 (1985), all to Paxton. Although inexpensive to manufacture, capable of use with bags having a short neck, and producible in break-off strips, such closures can be used only once if they are made of frangible plastic since they must be bent or twisted when being removed and consequently will fracture upon removal. Thus, to reseal a bag originally sealed with a frangible closure, one must either close its neck with another closure or else close it in make-shift fashion by folding or tying it. Although my own U.S. Pat. No. 4,694,542 (1987) describes a closure which is made of flexible plastic and is therefore capable of repeated use without damage to the bag, nevertheless all the plastic closures heretofore known suffer from a number of disadvantages:

(i) Their manufacture in color requires the use of a compounding facility for the production of the pigmented plastic. Such a facility, which is needed to compound the primary pigments and which generally constitutes a separate production site, requires the presence of very large storage bins for the pigmented raw granules and presents great difficulties with regard to the elimination of the airborne powder which results from the mixing of the primary granules.

(ii) If one uses an extruder in the production of a pigmented plastic—especially if one uses only a single extruder—a change from one color to a second requires purging the extruder of the granules having the first color by introducing those of the second color—a process which, until purging is complete, inevitably produces, in sizeable volume, a product which is of intermediate color and must be discarded as scrap, thereby resulting in waste of material and of production time.

(iii) The colors of the closures in present use are rather unsaturated. If greater concentrations of pigment were used in order to make the colors more intense, the plastic would become more brittle and the cost of the final product would increase.

(iv) The use of pigmented plastic closures does not lend itself to the production of multicolored designs, and it would be very expensive to produce plastic closures in which the plastic is multicolored—for example, in which the plastic has stripes of several colors, or in which the plastic exhibits multicolored designs.

(v) Closures made solely of plastic generally offer poor surfaces for labeling or printing, and the label or print is often easily smudged.

(vi) The printing on a plastic surface is often easily erased, thereby allowing the alteration of prices by dishonest consumers.

(vii) The plastic closures in present use are slippery when handled with wet or greasy fingers.

(viii) A closure of the type in present use can be very carefully pried off a bag by a dishonest consumer and then attached to another item without giving any evidence of such removal.

OBJECTS AND ADVANTAGES

Accordingly, besides the objects and advantages of the flexible closures described in my U.S. patent mentioned above, several objects and advantages of the present invention are (i) to provide a closure which can be produced in a variety of colors without requiring the manufacturer to use a compounding facility for the production of pigments;

(ii) to provide a closure whose production allows for a convenient and extremely rapid change of color in the closures that are being produced;

(iii) to provide a closure which both is flexible and can be brightly colored;

(iv) to provide a closure which can be colored in several colors simultaneously;

(v) to provide a closure which will present a superior surface for the reception of labeling or print;

(vi) to provide a closure whose labeling cannot be altered;

(vii) to provide a closure which will not be slippery when handled with wet or greasy fingers; and (viii) to provide a closure which will show evidence of having been switched from one item to another by a dishonest consumer—in other words, to provide a closure which makes items "tamper-proof."

Further objects and advantages are to provide a closure which can be used easily and conveniently to open and reseal a plastic bag, without damage to the bag, which is simple to use and inexpensive to manufacture, which can be supplied in separate tabs en masse or in break-off links (i.e., individual closures connected side-to-side or end-to-end), which can be used with bags having short necks, which can be used repeatedly, and which obviates the need to tie a knot in the neck of the bag or fold the neck under the bag or use a twist closure. Still further objects and advantages will become apparent from a consideration of the ensuing description and drawings.

DRAWING FIGURES

In the drawings, closely related figures are given the same numeric designation but different alphabetic suffixes. The distinctions between figures with different alphabetic suffixes are readily comprehended.

REFERENCE NUMERALS IN DRAWINGS

Figure 1A:
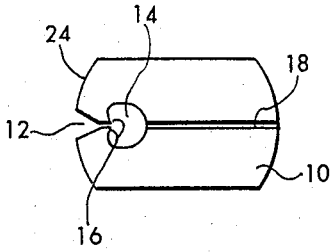
FIG. 1 shows various aspects of a closure supplied with a longitudinal groove and laminated on one side with paper.

10 base of closure
12 lead-in notch
14 hole
16 gripping points
18 groove
20 paper lamination
22 tear of paper lamination
24 corner
26 longitudinal through-hole
28 neck-down
30 side of base opposite to bend
32 crease in paper

DESCRIPTION-- FIGS. 1, 2, 3, 4, 5, 6

Figure 1B:
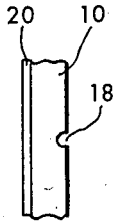
Figure 1C:
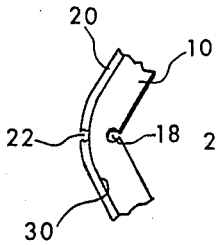
Figure 1D:
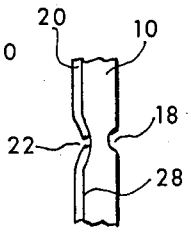

A typical embodiment of the closure of the present invention is illustrated in FIG. 1A (top view) and FIG. 1B (end view). The closure has a thin base 10 of uniform cross section consisting of a flexible sheet of material which can be repeatedly bent and straightened out without fracturing. Upon one side of base 10 is laminated a layer of paper (20 in FIG. 1B). In the preferred embodiment, the material of the base is a flexible plastic, such as poly-ethylene-tere-phthalate (PET here supplied to facilitate pronunciation)—available from Eastman Chemical Co. of Kingsport, Tenn.; however, the base can consist of any other material that can be repeatedly bent without fracturing, such as polyethylene, polypropylene, vinyl, nylon, rubber, leather, various impregnated or laminated fibrous materials, various plasticized materials, cardboard, paper, etc. At one end of the closure is a lead-in notch 12 terminating in gripping points 16 and leading to a hole 14. Paper layer 20 adheres to base 10 by virtue either of the extrusion of liquid plastic (which will form the body of the closure) directly onto the paper or the application of heat or adhesive upon the entirety of one side of base 10. With its paper lamination, the closure is then punched out, and the lamination will consequently have the same shape as the side of the base 10 to which it adheres.

Figure 6D:
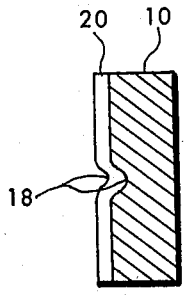
FIG. 6 shows end views of closures having various combinations of paper laminations, longitudinal grooves, and through-holes.
Figure 6G:
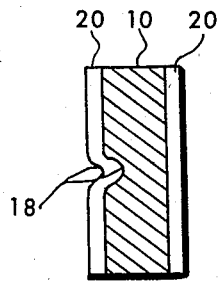
Figure 6I:
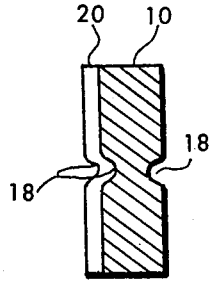
Figure 6K:
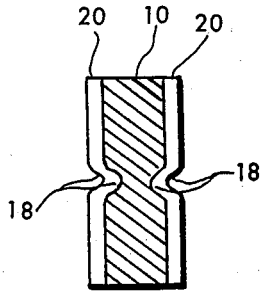
Figure 6A:
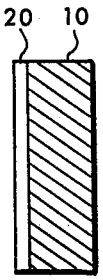
Figure 6B:
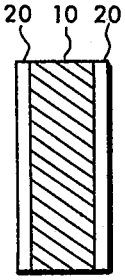
Figure 6C:
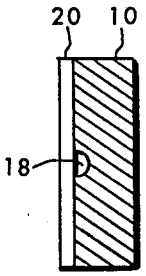
Figure 6E:
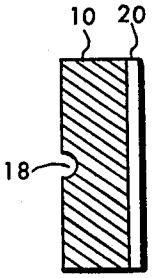
Figure 6F:
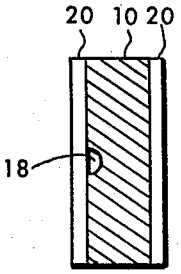
Figure 6H:
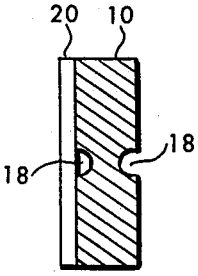
Figure 6J:
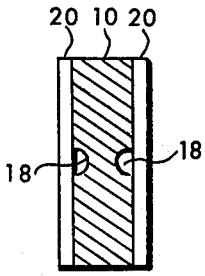
Figure 6L:
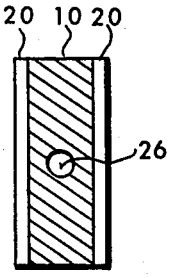

The base of the closure is typically 0.8 mm to 1.2 mm in thickness, and has overall dimensions roughly from 20 mm×20 mm (square shape) to 40 mm×70 mm (oblong shape). The outer four corners 24 of the closure are typically beveled or rounded to avoid snagging and personal injury. Also, when closure tabs are connected side-to-side in a long roll, these bevels or roundings give the roll a series of notches which act as detents or indices for the positioning and conveying of the tabs in a dispensing machine. A longitudinal groove 18 is formed on one side of base 10 in FIG. 1. In other embodiments, there may be two longitudinal grooves—one on each side of the base—or there may be no longitudinal groove at all. Groove 18 may be formed by machining, scoring, rolling, or extruding. In the absence of a groove, there may be a longitudinal through-hole 26 (FIG. 6L). This throughhole may be formed by placing in the extrusion path of the closure, a hollow pin for the outlet of air.

Figure 2:
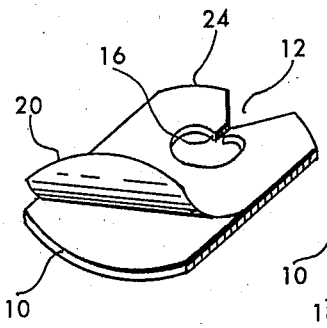
FIG. 2 shows a closure with no longitudinal groove and with paper lamination on one side only.
Figure 3:
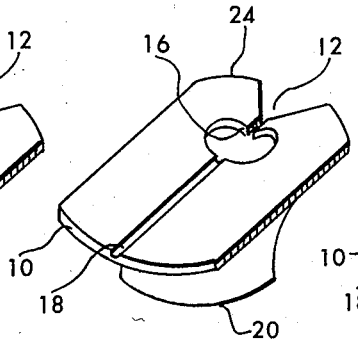
FIG. 3 shows a closure with one longitudinal groove and with paper lamination on one side only.
Figure 4:
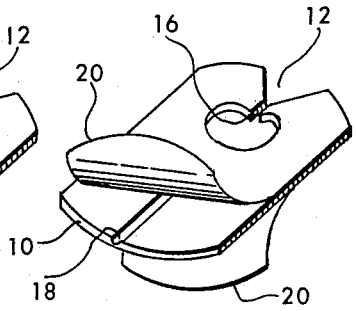
FIG. 4 shows a closure with one longitudinal groove and with paper lamination on both sides.
Figure 5:
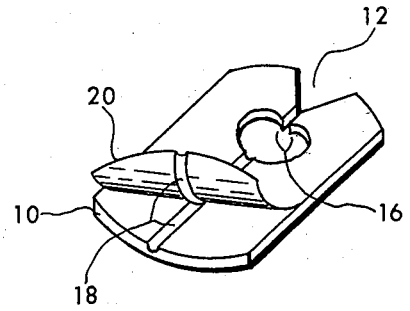
FIG. 5 shows a closure with one longitudinal groove and with paper lamination on one side only, the groove having been formed into the paper as well as into the body of the closure.

Some embodiments appear in FIGS. 2, 3, 4, and 5 (where in each case the paper lamination is shown peeled back a bit). In FIG. 2 appears a closure having only one lamination and no groove; in FIG. 3 appears a closure having only one lamination and only one groove; in FIG. 4 appears a closure having two laminations and only one groove; in FIG. 5 appears a closure having two laminations and one groove, the latter having been rolled into one lamination as well as into the body of the closure.

There are various possibilities with regard to the relative disposition of the sides which are grooved and the sides which are laminated, as are illustrated in FIG. 6, which presents end views along the longitudinal axis. FIG. 6A shows a closure with lamination on one side only and with no groove; FIG. 6B shows a closure with laminations on both sides and with no groove; FIG. 6C shows a closure with only one lamination and only one groove, both being on the same side; FIG. 6D shows a closure with only one lamination and only one groove, both being on the same side and the groove having been rolled into the lamination as well as into the the body of the closure; FIG. 6E shows a closure with only one lamination and only one groove, the two being on opposite sides; FIG. 6F shows a closure with two laminations and only one groove; FIG. 6G shows a closure with two laminations and only one groove, the groove having been rolled into one lamination as well as into the the body of the closure; FIG. 6H shows a closure with only one lamination and with two grooves; FIG. 6I shows a closure with only one lamination and with two grooves, one of the grooves having been rolled into the lamination as well as into the body of the closure; FIG. 6J shows a closure with two laminations and with two grooves; FIG. 6K shows a closure with two laminations and with two grooves, the grooves having been rolled into the laminations as well as into the body of the closure; FIG. 6L shows a closure with two laminations and a longitudinal through-hole.

From the description above, a number of advantages of my paper-laminated closures become evident:

(i) A few rolls of colored paper will contain thousands of square yards of a variety of colors, will obviate the need for liquid pigments or a pigment-compounding plant, and will permit the manufacturer to produce colored closures with transparent, off-color, or leftover plastic, all of which are cheaper than first-quality pigmented plastic.

(ii) With the use of rolls of colored paper to laminate the closures, one can change colors by simply changing rolls, thus avoiding the need to purge the extruder used to produce the closures.

(iii) The use of paper laminate upon an unpigmented, flexible plastic base can provide bright color without requiring the introduction of pigment into the base and the consequent sacrifice of pliability.

(iv) The presence of paper lamination on my closures will permit the display of multicolored designs.

(v) Although closures made solely of plastic generally offer poor surfaces for labeling or printing, and the label or print is often easily smudged, laminating the closure with paper, on the other hand, will result in a superior surface for labeling or printing, either by hand or by machine.

(vi) Although the printing on a plastic surface can sometimes be easily erased, thereby allowing the alteration of prices by dishonest consumers, erasure of a label on a paper-laminated closure will, on the other hand, leave a highly visible and permanent mark.

(vii) Although closures made solely of plastic are slippery when handled with wet or greasy fingers, the paper laminate on my closures will provide a nonslip surface.

OPERATION—FIGS. 1, 6, 7, 8

The manner of using a paper-laminated closure to seal a plastic bag is identical to that for closures in present use. Namely, one first twists the neck of a bag (not shown here but shown in FIG. 12 of my patent referred to supra) into a narrow, cylindrical configuration. Next, holding the closure so that the plane of its base is generally perpendicular to the axis of the neck and so that lead-in notch 12 is adjacent to the neck, one inserts the twisted neck into the lead-in notch until it is forced past the gripping points 16 at the base of the notch and into hole 14. To remove the closure, one first bends it along its horizontal axis (FIG. 1C—an end view—and FIGS. 7 and 8) so that the closure is still in contact with the neck of the bag and so that gripping points 16 roughly point in parallel directions. Then one pulls the closure up or down, and away from, the neck in a direction generally opposite to that in which the gripping points now point, thus freeing closure from the bag without damaging the latter. The presence of one or two grooves 18 or a longitudinal through-hole 26 (FIG. 6L), either of which acts as a hinge, facilitates this process of bending. Upon being subsequently flattened again, the closure can be used to reseal the original bag or to seal another bag many times.

Figure 7A:
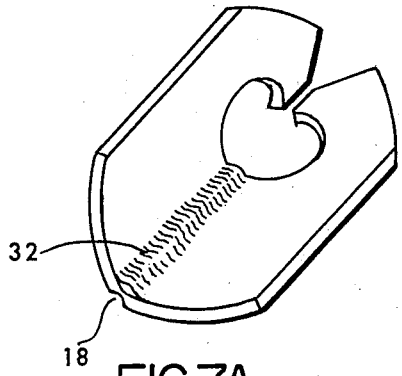
FIG. 7 shows a laminated closure with groove after being bent and after being straightened out again.
Figure 7B:
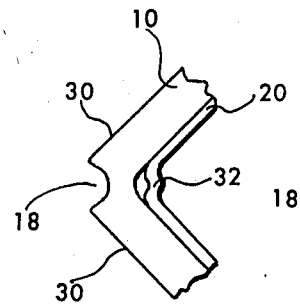
Figure 7C:
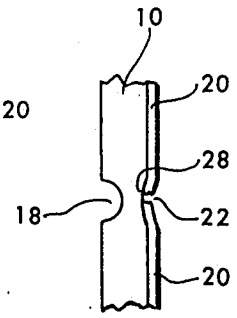
Figure 8A:
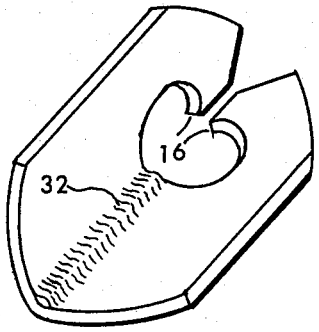
FIG. 8 shows a laminated closure without groove after being bent and after being straightened out again.
Figure 8B:
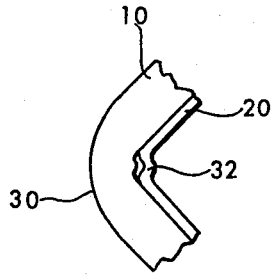
Figure 8C:
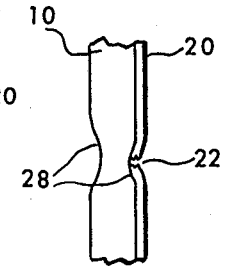

When the closure is bent along its longitudinal axis, the region 30 (FIGS. 1C, 7B, and 8B—all, end views) of the base—namely, the region which is parallel to this axis and is on the side of the base opposite to the bend—will stretch somewhat along the direction perpendicular to the longitudinal axis. Therefore, when the closure is flattened out again, the base will have elongated in the direction perpendicular to the longitudinal axis, and so a necking down 28 (FIGS. 1D, 7C, and 8C—all, end views) of the base will result, as well as will either a tell-tale tear 22, or at least a crease 32 (FIGS. 7A and 8A), in the paper lamination along the axis of bending. Therefore, if the closure is attached to a sales item and has, printed upon its paper lamination, information as to price or other aspects of this item, the fact that the closure is transferred by a dishonest consumer from the first item to another will be made evident by the tear or crease. In FIGS. 7A and 8A, we see bent closures with and without grooves, respectively, and in FIGS. 7C and 8C, we see the same closures, respectively, after being flattened out, end on along the longitudinal axes, the paper tear 22 being visible.

SUMMARY, RAMIFICATIONS, AND SCOPE

Accordingly, we see that my paper-laminated closure with a thin flexible base can be used to seal a plastic bag easily and conveniently, can be removed just as easily and without damage to the bag, and can be used to reseal the bag without requiring a new closure. In addition, when a closure has been used to seal a bag and is later bent and removed from the bag so as not to damage the latter, the paper lamination will tear or crease and thus give visible evidence of tampering, without impairing the ability of the closure to reseal the original bag or any other bag. Furthermore, the paper lamination has the additional advantages in that:

it permits the production of closures in a variety of colors without requiring the manufacturer to use a separate facility for the compounding of the powdered or liquid pigments needed in the production of colored closures;

it permits an immediate change in the color of the closure being produced without the need for purging the extruder of old resin;

it allows the closure to be brightly colored without the need to pigment the base itself and consequently sacrifice the flexibility of the closure;

it allows the closure to be multicolored since the paper lamination offers a perfect surface upon which can be printed multicolored designs;

it provides a closure with a superior surface upon which one can label or print;

it provides a closure whose labeling cannot be altered or erased without resulting in tell-tale damage to the paper lamination;

and it provides a closure which will not be slippery when handled with wet or greasy fingers, the paper itself providing a nonslip surface.

Although the description above contains many references to specific versions and aspects of the invention, this circumstance should not be construed as limiting the scope of the invention but as merely providing illustrations of some of the presently preferred embodiments of this invention. For example, the closure can have other shapes, such as circular, oval, trapezoidal, triangular, etc.; the lead-in notch can have other shapes; the groove can be replaced by a hinge which connects two otherwise unconnected halves. Thus, the scope of this invention should be determined by the appended claims and their legal equivalents, rather than by the examples given in the descriptions above.

I claim:

1. In a bag closure of the type comprising a flat body of material having two major sides which face in opposite directions, a lead-in notch beginning at one edge of said body of material and extending into said body, a gripping aperture in said body which is adjacent to and which communicates with said notch, and a layer of paper laminated to one side of said body, the improvement wherein said flat body of material .

(a) is made of a flexible plastic of the type which can be repeatedly bent and straightened without fracture, (b) is elongated, and (c) has a longitudinal groove on said one side of said body which extends the full length of said one side, from said gripping aperture to the opposite edge, whereby said closure can be bent so that it can easily be removed from a bag without damaging said bag, and thereafter can be straightened so that it can be re-used as a closure on said bag, and whereby any bending of said closure will cause said paper layer to tear or be distorted so as to leave an indication that said closure was bent and possibly removed and replaced.

2. The closure of claim 1 wherein said body of material is composed of polyethyleneterephthalate.

3. The closure of claim 1 wherein said groove is formed into and along the full length of said layer of paper.

4. The closure of claim 1 wherein said body of material has two longitudinal grooves on respective opposite sides of said body, said grooves extending the full lengths of said respective opposite sides, from said gripping aperture to the opposite edge.

5. The closure of claim 4 wherein the groove on said one side of said body of material is formed into and along the full length of said layer of paper.

6. The closure of claim 1 wherein said body of material has paper layers laminated to both of said sides, respectively, of said body of material.

7. The closure of claim 6 wherein two grooves are formed on opposite sides of said body of material, said grooves extending the full lengths of said opposite sides, from said gripping aperture to the opposite edge.

8. The closure of claim 2 wherein said grooves are formed into and along the full lengths of said layers of paper, respectively.

9. The closure of claim 1 wherein said layer of paper is colored.

* * * * *

UNITED STATES PATENT AND TRADEMARK OFFICE

CERTIFICATE OF CORRECTION

PATENT NO. : 4,783,886
DATED : 1988 Nov 15
INVENTOR(S) : Koppe, Lou W.

It is certified that error appears in the above-identified patent and that said Letters Patent are hereby corrected as shown below:

Col 3, line 62, change "(20 in FIG 1B)" to --20 (FIG 1B)--.

Col. 3, line 64, change "PET" to --abbreviated PET; hyphens--.

Signed and Sealed this

Fourteenth Day of March, 1989

*Attest:*

DONALD J. QUIGG

*Attesting Officer*

*Commissioner of Patents and Trademarks*